US005118021A

United States Patent [19]

Fiocchi

[11] Patent Number: 5,118,021

[45] Date of Patent: Jun. 2, 1992

[54] PILL SPLITTER

[75] Inventor: James Fiocchi, Highland Park, Ill.

[73] Assignee: American Medical Industries, Highland Park, Ill.

[21] Appl. No.: 698,267

[22] Filed: May 10, 1991

[51] Int. Cl.[5] ..... B26F 3/00

[52] U.S. Cl. ..... 225/103; 241/DIG. 27; D24/101

[58] Field of Search ..... 241/DIG. 27; 225/93, 225/96.5, 103, 104; D24/100, 101

[56] References Cited

U.S. PATENT DOCUMENTS

| | | | |
|---|---|---|---|
| D. 310,731 | 9/1990 | Lieptz | D24/101 X |
| 926,327 | 6/1909 | Hoffman . | |
| 2,274,250 | 2/1942 | Simpkins . | |
| 2,602,596 | 7/1952 | Jones et al. . | |
| 2,655,259 | 10/1953 | Davoren | 225/103 X |
| 2,726,816 | 12/1955 | Brantley . | |
| 2,892,595 | 6/1959 | Tupper . | |
| 3,815,802 | 6/1974 | Stevens | 225/96.5 X |
| 4,159,568 | 7/1979 | Berner | 225/103 X |
| 4,173,826 | 11/1979 | Leopoldi et al. | 241/DIG. 27 X |
| 4,209,136 | 6/1980 | Linden et al. . | |
| 4,348,950 | 9/1982 | Harris . | |
| 4,366,930 | 1/1983 | Trombetti, Jr. . | |
| 4,422,553 | 12/1983 | Hoeks et al. | 225/96.5 X |
| 4,765,549 | 8/1988 | Sherman | 241/DIG. 27 X |
| 4,887,755 | 12/1989 | Gibilisco | 241/DIG. 27 X |

*Primary Examiner*—Mark Rosenbaum
*Assistant Examiner*—Frances Chin
*Attorney, Agent, or Firm*—Niro, Scavone, Haller & Niro

[57] ABSTRACT

A device for splitting an object, preferably a pill, tablet, capsule or caplet of any of a variety of shapes or sizes, the device having a base with a pill receptacle for receiving and centering the pill. The device also includes a hinged top with a blade adapted for entering the receptacle and engaging and splitting the pill when the cap is closed. The device is adapted to be used as a cap for a container for storing the pills, tablets or caplets to be split.

17 Claims, 2 Drawing Sheets

FIG. 1
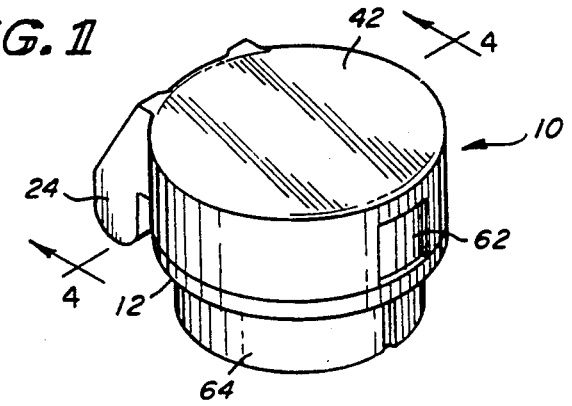
FIG. 2
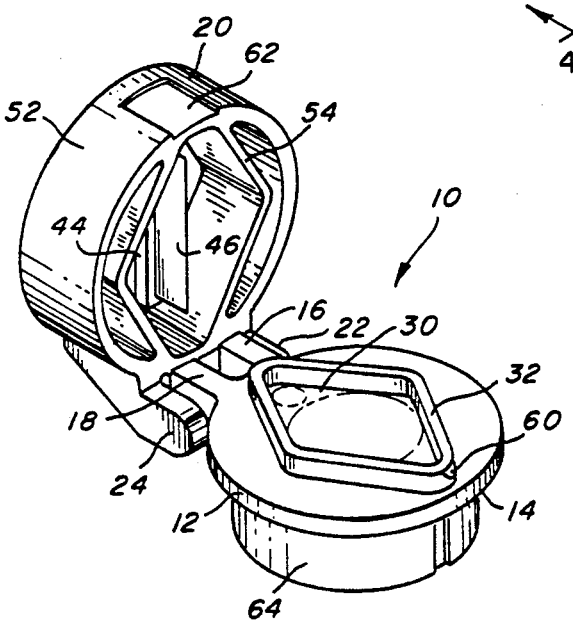
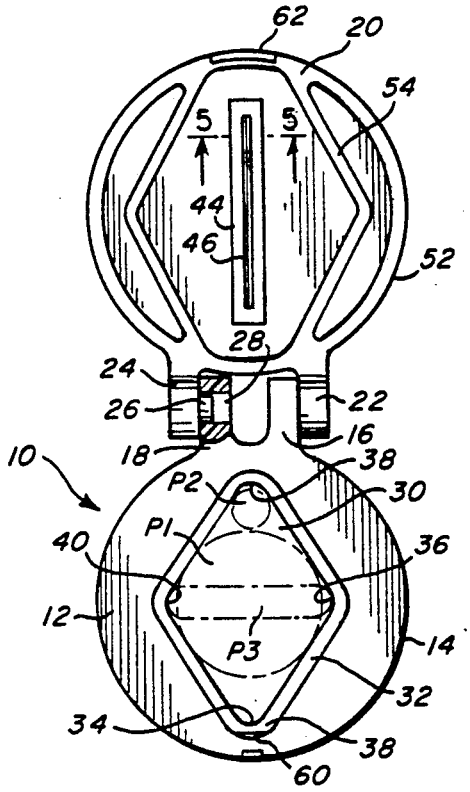
FIG. 3
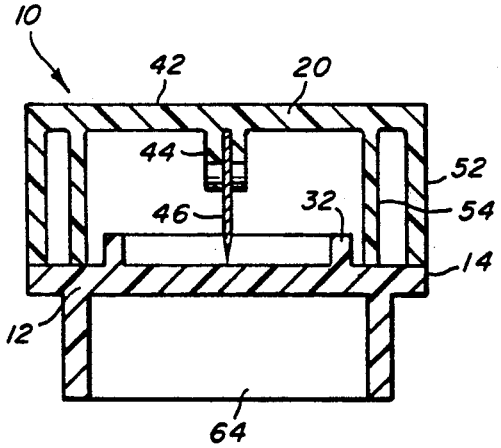
FIG. 4
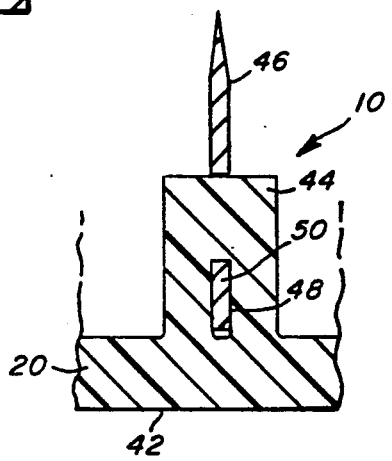
FIG. 5

PILL SPLITTER

BACKGROUND OF THE INVENTION

1. Field of the Invention

This invention relates to hand-held devices for splitting small solid objects, and in particular, to a hand-held, portable pill splitter for splitting medicinal tablets and the like so that they may be more readily swallowed.

2. Description of the Prior Art

Individuals are often required to take medication in some form of tablet, pill or caplet and depending on the condition of the individual and the type of tablet, some tablets are difficult to swallow in their whole form. Also, particularly with respect to children, the dosage contained in the standard tablet may be more than is required, necessitating that the tablet or pill be broken into smaller pieces. This problem not only arises in the realm of human consumption, but in animals and pets as well. In particular, small pets such as dogs and cats, require that the standard manufacturer's dosage be reduced by breaking the tablet prior to consumption.

A number of pill splitters are currently available, as disclosed in U.S Pat. No. 2,655,259 issued to W. Davoren on Oct. 13, 1953; U.S. Pat. No. 3,815,802 issued to R. Stevens on Jun. 11, 1974; U.S. Pat. No. 4,159,568 issued to H. Berner on Jul. 3, 1979; U.S. Pat. No. 4,422,553 issued to H. Hoeks et al on Dec. 27, 1983; and Des. 310,731 issued to N. Lieptz on Sept. 18, 1990. While all of the devices disclosed in these patents provide various means for splitting or breaking small objects such as pills and the like, none of them are readily adaptable for use to split pills and tablets in all of the various forms sold today, particularly in the various forms of prescriptions drugs and over-the-counter medications available. For example, none of the devices readily accepts and properly centers an elongated caplet for splitting it in half. Also, a number of the devices in the prior art are designated to be used with specific types of medication where the pill is either marked or scored, or the medicinal capsules are specifically designed to be used with the opener or splitter provided.

There is a need, heretofore not met, for providing a pill splitter which is readily adapted to be used with a large variety of pills, capsules, caplets and tablets available both for over- the-counter medications and prescription drugs.

SUMMARY OF THE INVENTION

The subject invention is related to a device for splitting small solid objects into two pieces and is particularly well-suited for splitting into two halves any of a variety of pills, tablets, capsules, caplets and the like regardless of size and/or shape. The splitter of the subject invention includes a base for supporting the object and a receptacle adapted for receiving and centering any of a variety of object shapes. A top or cover is hinged to the base and movable between an open position permitting insertion of the object and a closed position which brings a blade into contact with the object for severing or splitting the object into two pieces.

In the preferred embodiment of the invention, the top or cover of the device includes an outer wall which substantially conforms to the shape of the base and an inner wall which defines a shield around the blade to protect the user from accidental contact. The shield conforms substantially to the shape of the receptacle and when the cover is closed, provides a nested relationship between the cover and the base. The cover includes a blade holder adapted to receive a sharp metallic blade such as a standard single-edge razor blade or the like. Thus, as the blade becomes dull and of reduced functionality, the blade may be replaced.

In its preferred form, the base of the splitter defines a cap or closure plug for a container specifically designed to store a plurality of the objects to be split. The container includes a pestle on its outer bottom end which is adapted to be used with a complementary mortar, whereby the pill, tablets, caplets or the like stored in the container may also be pulverized and be reduced to a powdered form to further facilitate the dispensing of the medicine. Such may be necessary and convenient where it is impractical for the individual to take a proper dosage in the form supplied by the manufacturer.

The preferred embodiment of the invention includes a pill splitter, container and pill pulverizer in an assembled package. The pestle defining container is nested in the complementary mortar and the container is capped by the pill splitter. The splitter base may be enlarged relative to the container and mortar, facilitating ease of removal for access to the contents.

The preferred embodiment of the splitter device is of a snap together construction with a snap-type closure being provided to secure the cover to the base when the cover is closed.

It is, therefore, an object and feature of the subject invention to provide for a convenient splitting device for splitting a variety of sized and shaped small solid objects into two pieces.

It is another object and feature of the invention to provide for a pill splitting device which readily accepts and centers any of a variety of pills, tablets, capsules, caplets and the like, regardless of size and/or shape.

It is yet another object and feature of the invention to provide for a pill splitting device which is an integral part of a container for storing a plurality of objects to be split.

It is also an object and feature of the subject invention to provide a device for storing, pulverizing, and/or splitting pills, tablets, capsules, caplets and the like.

Other objects and features of the invention will be readily apparent from the accompanying drawings and description of the preferred embodiments which follow.

BRIEF DESCRIPTION OF THE DRAWINGS

FIG. 1 is a perspective view of the splitter device of the subject invention.

FIG. 2 is a perspective view looking in the same direction as FIG. 1, showing the splitter device with the top open.

FIG. 3 is a top elevation view of the splitter of FIGS. 1 and 2, with the top in the fully opened position.

FIG. 4 is a section view of the splitter device taken generally along the line 4—4 of FIG. 1.

FIG. 5 is a fragmentary section view taken along the line 5—5 of FIG. 3.

DETAILED DESCRIPTION OF THE PREFERRED EMBODIMENTS

Figure 6:
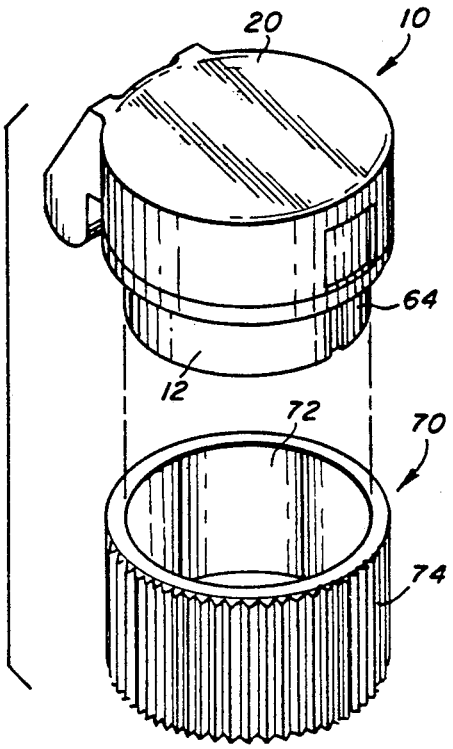
FIG. 6 is an exploded perspective view of an alternative embodiment of the invention showing the splitter device in conjunction with an integral container.

The preferred embodiment of a pill splitter made in accordance with the subject invention is illustrated in FIGS. 1-5 and is designated generally by the reference numeral 10. The pill splitter includes a relatively flat base 12 having an outer perimeter 14 with a pair of radially extending tabs 16 and 18. The top or cover 20 includes a pair of outwardly and downwardly extending fingers or projections 22 and 24. As shown in FIG. 3, the projections 22 and 24 each include a hinge pin 26 which is adapted to be received in a suitable aperture 28 in the respective extensions 16 and 18. The cover is pivotable about the hinge and movable between the closed position of FIG. and the opened positions of FIGS. 2 and 3.

In its preferred form, the base 12 includes an object receptacle 30 which is formed by the upstanding closed wall 32. The closed wall 32 is preferably rigid in its structure. As is specifically shown in FIG. 3, the receptacle is a closed parallelogram formed by the upstanding wall 32 and has radial corners at 34, 36, 38 and 40. The specific shape of the receptacle and radial corners permits the receptacle to readily center a plurality of pills, tablets, capsules, caplets and the like whether the objects to be split are of a large circular shape P1, a smaller circular shape P2 or of an elongated cylindrical shape P3, all shown in phantom in FIG. 3. The top includes an upper wall 42 which has mounted in its interior surface a blade holder 44 (FIG. 2). The blade holder 44 is adapted to receive and secure a cutting blade 46. It is a feature of the present invention that the cutting blade may be made of a material distinct from the pill splitter top and base, and may comprise, by way of example, a common single edge razor blade. The through slots 48 (FIG. 5) in the blade holder outer edges are adapted to receive the enlarged end 50 of a common razor blade for securing it in place during use. Thus, the invention readily receives blades 46 available from a common source, greatly decreasing the expense of manufacture of the device. The base 12 and the top 20 may each be made of a molded plastic material in single unitary molds. As can be seen in FIG. 4, when the top 20 is closed onto the base 12, the blade 46 enters the receptacle 32, holding the pill, tablet, capsule, caplet or the like centered therein, and engages and splits any solid object contained within the receptacle.

In the preferred embodiment, the top 20 includes an outer peripheral wall 52 which conforms substantially to the shape of the perimeter 14 of the base. An inner wall 54 is provided in the top to shield the blade 46 and protect the user against accidental contact. As best shown in FIGS. 3 and 4, the inner wall is designed to conform substantially to the shape of the parallelogram receptacle defined by the wall 32 and is dimensioned to be slightly larger than the receptacle so that when the cover 20 is closed, the shield 54 and the receptacle wall 32 are disposed in nested relationship as shown in FIG. 4. In the preferred embodiment, the outer tip 58 of the receptacle wall 32 includes a protrusion 60 adapted to engage and frictionally hold the inner surface of the wall 50 securing the top in the closed position. A thumb or finger recess 62 is provided in the wall 52 of the cover and is disposed radially opposite the hinge pins 26 to facilitate opening of the cover during use.

As shown in FIG. 6, the pill splitter of the subject invention may be adapted to be used in conjunction with a pill container 70. In this regard, the base 12 of the splitter includes a lower extending portion 64 which is designed to form a plug or cap for closing the open top 72 of the container 70. The cylindrical extending portion 64 of the base is dimensioned so that it forms a snug fit with the open top 72 of the container. The container 70 has a knurled exterior surface 74 to facilitate grasping of the container during use. As is best shown in FIG. 8, the perimeter 14 of the base is slightly larger than the outer wall surface 74 of the container to facilitate removal of the cap from the container.

Figure 7:
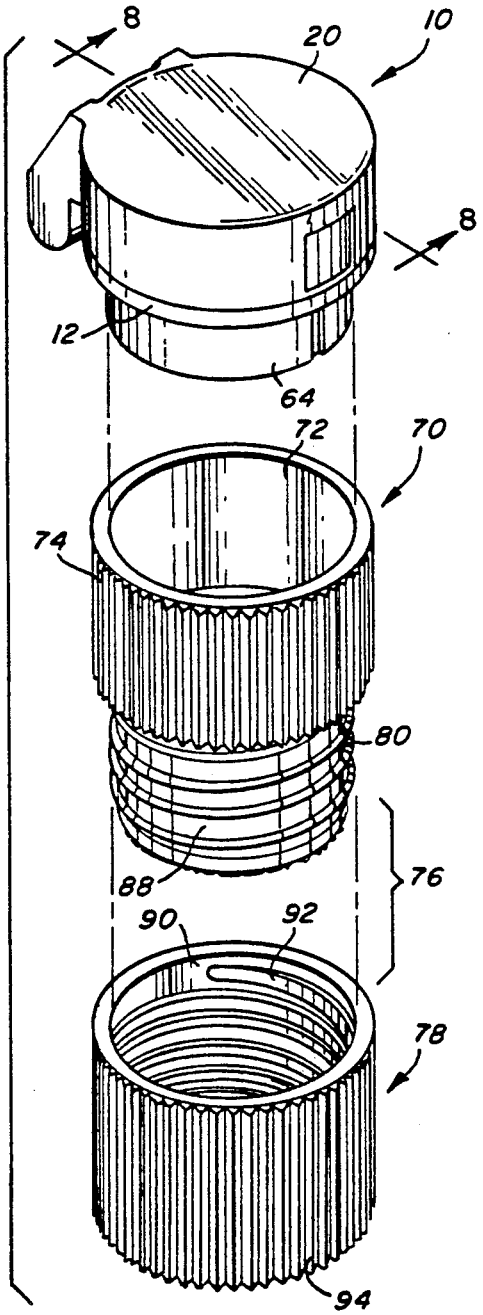
FIG. 7 is an exploded perspective view of another alternative embodiment of the invention showing the splitter device in combination with a container and pulverizer.
Figure 8:
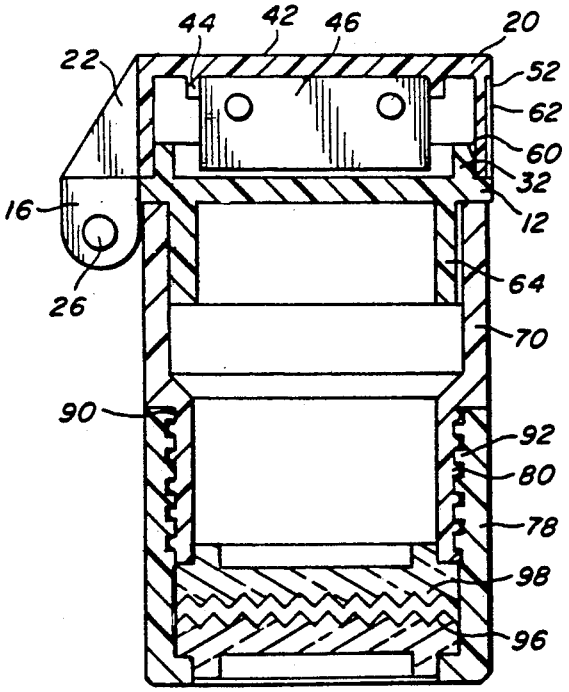
FIG. 8 is a section view of the embodiment of FIG. 7 in assembled relationship, taken generally along the line 8—8 of FIG. 7.

Another embodiment of the invention is disclosed in FIGS. 7 and 8, wherein the pill splitter 10 can be used in conjunction with a combination pill pulverizer and container 76, which comprise the container 70 which also functions as a pestle and the complementary mortar 78.

The construction and function of the combination container/pulverizer is more clearly described in issued U.S. Pat. No. 4,765,549, entitled "TABLET PULVERIZER", assigned to American Medical Industries, the same assignee as the present application, dated Aug. 23, 1988, and incorporated by reference herein. As there shown, the container 70 includes an interior compartment for holding and storing a plurality of tablets or pills. The container includes a peripheral thread 80 about a reduced end portion 88. The mortar 78 has an internal cavity or mouth 90 about which is provided with an internal thread 92 for complementary engagement with the peripheral thread 80 of the container 70. The mortar has an outside diameter which is knurled at 94 and is of the same diameter as the major outside knurled surface of the container 70. As shown in FIG. 8, either one or both of the inside bottom wall 96 of the mortar 78 and the outside end wall 98 of the pestle container 70 include a series of protrusions. Where desired, a tablet, pill, capsule, caplet or the like may be placed in the mortar 78 and the container 70 may be threaded into the mortar and into the position as shown in FIG. 8 to crush the pills between the mortar and pestle surfaces, pulverizing the pill, tablet, capsule or caplet into a powdered form.

It will be understood that the invention may embody other specific forms without departing from the spirit or central characteristics thereof. The present examples and embodiments, therefore, are to be considered in all respects as illustrative and not restrictive, and the invention is not to be limited to the details given herein, but includes all enhancements and modifications within the scope and spirit of the following claims.

What is claimed is:

1. A hand-held device for splitting small objects into two pieces, comprising:

a base having an outer perimeter;

a receptacle in said base and having an enclosed rigid perimeter wall for receiving and centering any of a variety of small objects of different size and shape;

a top hingedly secured to the base and movable between opened and closed positions relative thereto having an inner wall substantially the same shape as said perimeter wall and slightly larger so that said inner wall surrounds said perimeter wall when said top is in the closed position; and a blade supported by the top and movable therewith to move into and out of the receptacle for engaging and splitting an object therein when the top is moved from the opened to the closed position.

2. The device of claim 1, wherein the perimeter of said receptacle is defined by a rigid upstanding wall having an inside surface and an outside surface projecting upwardly from said base and forming a parallelogram.

3. The device of claim 2, wherein said top includes an outer peripheral wall conforming substantially to the outer perimeter of the base and an inner wall for surrounding and shielding the blade.

4. The device of claim 3, wherein the inner wall of said top is dimensioned to be positioned outside the closed perimeter of the receptacle when said top is closed.

5. The device of claim 4, wherein the inner wall conforms to the shape of the closed perimeter of said receptacle.

6. The device of claim 5, wherein said receptacle comprises a raised wall projecting upwardly from said base, and wherein said top inner wall conforms tot eh shape of said raised receptacle wall and in close relation laterally to said outside surface of said receptacle wall, the perimeter of the raised receptacle wall being smaller than the perimeter of said top inner wall, whereby said shield and receptacle form a nested relationship when said top is closed relative to said base.

7. The device of claim 6, wherein said receptacle includes a latch portion of said rigid upstanding wall disposed in the perimeter thereof and wherein said top inner wall includes a recessed region providing a friction closure latch with said latch portion of said upstanding wall for securely holding the top in a closed position.

8. The device of claim 1, wherein said top further includes a blade holder and wherein said blade holder comprises a blade inserted in and securely held by said holder.

9. A device of claim 8, wherein said blade is made of a razor blade.

10. The device of claim 1, including an integral snap closure latch on said top for securely holding the top in the closed position.

11. The device of claim 1, wherein said base includes an elongated lower section with an outer wall surface extending downwardly from said receptacle, said elongated lower section defining a plug closure means for a container having an inner wall surface; said outer wall surface of said elongated lower section engages with said inner wall surface of said container forming a friction fit.

12. The device of claim 11, including a container having an open end and a closed bottom, the open end adapted for receiving the closure end of said base, whereby said closure end forms a cap for said container; said cap has a cross-sectional shape substantially equal tot eh cross-sectional shape of said container so as to maintain a uniform circumference throughout the entire device.

13. The device of claim 12, wherein the closed bottom of the container defines a pestle and wherein the device further includes:

a mortar adapted to receive said container; and a plurality of protrusions on at least one of said pestle and said mortar projecting toward the other of the said pestle and said mortar, whereby movement of the mortar relative to the pestle will facilitate crushing of a solid object placed therebetween.

14. The device of claim 13, wherein the closed end of said container includes peripheral thread means and wherein the mortar includes complementary thread means for engagement with the peripheral thread means of the container for moving the pestle into engagement with the mortar upon relative rotation thereof in one direction to crush said solid object interposed therebetween.

15. The device of claim 11, wherein said closure section of the base and said open end of said container form a snug fit.

16. The device of claim 11, wherein the outer perimeter of said base is larger than the outer perimeter of the open end of said container for facilitating removal of the base closure end from said container.

17. A portable pill splitter comprising:

a circular base;

a pill receptacle in the base defined by a rigid wall having a inner and outer surface projecting upwardly from the base and defining a perimeter in the shape of a parallelogram adapted for receiving and centering any of a variety of pills of different size and shape;

a top hingedly secured to the base and movable between open and closed positions relative thereto;

a blade supported by the top and movable therewith to move into and out of said pill receptacle for engaging and splitting the pill in said pill receptacle when the top is moved from the open to the closed position; and a shield surrounding the blade and conforming substantially to the shape of said pill receptacle, the perimeter of the receptacle being smaller in dimension than said perimeter of said shield, whereby said shield and receptacle form a nested relationship when said top is closed relative to said base.

* * * * *